US005275183A

United States Patent [19]

Landry

[11] Patent Number: 5,275,183

[45] Date of Patent: Jan. 4, 1994

[54] SELF-OPERABLE PORTABLE HAND HAIR TAMER

[76] Inventor: Conrad Landry, 6300 Chambois, St. Leonard, Qc H1P 1S2, Canada

[21] Appl. No.: 12,417

[22] Filed: Feb. 2, 1993

Related U.S. Application Data

[63] Continuation-in-part of Ser. No. 889,210, May 20, 1992, abandoned.

[51] Int. Cl.[5] ..... A45D 20/08

[52] U.S. Cl. ..... 132/271; 132/238

[58] Field of Search ..... 132/227, 228, 229, 237, 132/238, 239, 271

[56] References Cited

U.S. PATENT DOCUMENTS

| | | | |
|---|---|---|---|
| 3,890,984 | 6/1975 | Lesetar | 132/271 |
| 3,894,547 | 7/1975 | Scivoletto | 132/119.1 |
| 3,901,249 | 8/1975 | Russell | 132/271 |
| 4,210,162 | 7/1980 | Dreyer et al. | 132/271 |
| 4,250,902 | 2/1981 | Ihara | 132/271 |
| 4,328,818 | 5/1982 | Glucksman | 132/271 |
| 4,910,381 | 3/1990 | Reichle et al. | 132/238 |
| 4,926,027 | 5/1990 | Montagino et al. | 132/271 |
| 4,935,643 | 6/1990 | Reichle et al. | 132/238 |
| 4,955,145 | 9/1990 | Scivoletto | 132/271 |
| 5,091,630 | 2/1992 | Djuric | 132/271 |

*Primary Examiner*—Gene Mancene
*Assistant Examiner*—Frank A. LaViota
*Attorney, Agent, or Firm*—Antoine H. Gauvin

[57] ABSTRACT

This self-operable portable hand hair tamer for short hair particularly rebel short hair, has a central hot air blowing dryer having a narrow nozzle outlet to blow at high velocity a narrow converging jet of hot air. A pair of hollow arms have one of their ends rotatably mounted to the blowing dryer, for rotational displacement of the narrow nozzle with respect to the arms and to sandwich the nozzle between the arms. The arms at their other end, are provided with a rotating curling brush to grasp and loop short hair. A link also bridges the arms. The curling brushes are operatively connected to the rotational displacement of the nozzle with respect to the arms, to rotate the curling brush at a given angle selected between 80° to 110° from an original position.

20 Claims, 6 Drawing Sheets

SELF-OPERABLE PORTABLE HAND HAIR TAMER

This application is a continuation-in-part of U.S. application Ser. No. 07/889,210 dated May 20, 1991 which is now abandoned.

BACKGROUND OF THE INVENTION

1. Field of the invention

This invention relates to a self-operable portable hand hair tamer for short hair and more particularly to such an apparatus having a partially rotatable curling brush to grasp and loop rebel short hair, said brush cooperating with a means to blow a jet of hot air against said curling brush at a critical location.

2. Description of related art

A large number of men are plagued with one or more tufts of hair growing in undesired directions, denying them the pleasure of presenting a neatly groomed head. Professional hairdressers manage to set and groom such hair by first shampooing and towel drying the hair. If desired, for lasting results, a small amount of styling cream or gel is massaged in the hair. Then with a hairbrush resting on hair, strands of hair are picked with the bristles and with a flick of the wrist, the hair is curved back onto itself to form a loop-like configuration between the hairbrush and a client's head while the mouth of a hair dryer is directed where the hair forms a curl in order to set said configuration. The same procedure is repeated as needed.

In U.S. Pat. No. 3,894,547 dated Jul. 15, 1975, Scivoletto teaches a hair dryer for wrapping around the strands of hair with a motor driven comb assembly. The immobility of the blower outlet prevents a proper direction of air flow. Short rebel hair will not readily wrap around the comb.

In U.S. Pat. No. 3,901,249 dated Aug. 26 1975, Russel teaches a hair brushing and drying device in which an operator can brush hair of a subject while directing a stream of air in a direction transverse to the longitudinal axis of the brush. This device which must be used by an operator, is for styling lasting curls or soft waves and to add volume into chin-length or longer hair. Short rebel hair will not readily wrap around the brush.

In U.S. Pat. No. 4,629,863 dated Dec. 16, 1986, Giordano teaches a special mouth piece for a hair dryer to protect the scalp from a flow of hot hair, the operation of a brush shown in the Patent, being left to speculation.

In U.S. Pat. No. 4,910,381 dated Mar. 20, 1990, Reichle teaches a reversible motor for driving a curling iron, indicative of the need to wind the air, and an elbow to change the air direction. An outflow nozzle directs hot air tangentially to the curling iron.

In U.S. Pat. No. 4,935,643 dated Jun. 19, 1990, Reichle et al teach a hair treatment device with a winding mandrel driven by a motor.

Lesetar in U.S. Pat. No. 3,890,984 dated June 1975, Glucksman in U.S. Pat. No. 4,328,818 dated May 11 1982, Montagino et al in U.S. Pat. No. 4,926,027 dated May 1990 as well as Ihara in U.S. Pat. No. 4,250,902 dated February 1981 cannot yield applicant's invention as the air velocity is not sufficient to freeze rebel hair to a curled configuration and should hot air velocity be increased scalp injuries would most likely result.

In Russel,(which is not intended for self use), the two Reichle, or Scivoletto as defined above or Scivoletto in U.S. Pat. No. 4,955,145 dated September 1990, hair is wound on a brush, comb or curling iron, indicative of long hair. Rebel short hair will not be managed in this manner. The user's scalp is unprotected.

Again in following the Dreyer et al's teaching, in U.S. Pat. No. 4,210,162 dated July 1980, one is unable to manage short hair. The device is also cumbersome. The aim of the Patent is to act contrary to Applicant's application and to dry the free ends of the hair, not the base as is needed to treat rebel short hair.

None of the above patents taken alone or in combination, is suitable for styling short hair and particularly rebel hair.

SUMMARY OF THE INVENTION

Broadly stated the invention is directed to a self-operable portable hand hair tamer for styling short hair, particularly rebel short hair, comprising:

a central hot air blowing dryer having a narrow nozzle outlet to blow at high velocity a narrow converging jet of hot air, a pair of hollow arms, said arms having one end and another end and a longitudinal axis between said ends, said blowing dryer being rotatably mounted, and sandwiched between said one end of each of said arms, for rotational displacement of said narrow nozzle with respect to said arms, a traverse member to bridge said arms, between their respective said one end and another end said transverse member having a top, and a bottom outer surface, each of said arms at their other end defining an extension perpendicular to said longitudinal axis of said arms and away from said longitudinal axis of said arms and said traverse member, and said extensions being provided with means for rotating in between them, a curling brush to grasp and loop short hair, said brush having a center and a periphery, said means for rotating said curling brush being operatively connected to a means responsive to said rotational displacement of said nozzle with respect to said arms, whereby upon rotational displacement of said nozzle from an original position away from said curling brush to a position wherein said narrow nozzle outlet delivers said narrow converging jet of hot air between the center of said brush and the periphery of said brush adjacent to a user's head, said curling brush rotates at a given angle selected between 80° to 110° from an original position and in a direction such that said periphery, of said brush adjacent to a user's head, is displaced in a direction against the direction of said jet of hot air.

said top outer surface of said traverse member cooperating with said hot air blowing dryer to stop rotation of said narrow nozzle outlet so as to delivery said narrow converging jet of air between the center of said brush and within the periphery of said brush to be adjacent to the user's head, whereby upon laying the bottom outer surface of said traverse member against a user's head and rotationally displacing said nozzle from said original position away from said curling brush to said position toward said curling brush, said brush rotates at said given angle, on the user's head and thereby without wrapping said hair around said brush, to releasably hold said brush at said given angle to entrap the free ends of said short hair and to lay in a curved fashion the short hair on the periphery of said brush located between the center of the brush and said user's head, the hair between said brush and said head being entrapped and curled by said brush and immediately receiving said narrow converging jet of air between the center of said brush and within the periphery of said brush adjacent to said user's head until said nozzle returns to its original position.

Preferably this self-operable portable hand hair tamer for short hair, particularly rebel short hair, includes a means to return said brush in said original position. Preferably this self-operable portable hand hair tamer for short hair includes also a means for allowing said narrow nozzle outlet to stop short of the periphery of said brush adjacent a user's head, to direct said narrow converging jet of hot air parallel to or slightly toward said center to target said narrow converging jet of hot air on an area about mid-point between said center and the periphery of said brush adjacent a user's head.

The present invention aims at styling accurately and automatically short hair, particularly rebel short hair.

In a particular embodiment, a hand hair tamer integrating an efficient curling brush and a hot air source into a sturdy compact unit is obtained.

In another particular embodiment, a light-weight hand hair tamer is provided, for an operator to use on any part of his own head without any assistance.

In another particular embodiment, a light-weight hand hair tamer is provided to receive a plurality of various types of easily removable curling brushes having various diameters, bristle structures and configurations.

The invention is also directed to a self-operable portable hand hair tamer as defined above, wherein said central hot air blowing dryer having a narrow nozzle outlet is mounted in a central housing, said pair of arms are rotatably mounted to said housing, one of said arms is provided, at said one end, with a passage for bridging within said arms a connecting member to the central housing for transmitting the rotary motion of said housing with respect to said arms, said connecting member being provided with a means to urge said housing with respect to said arms at an acute angle, said means for rotating a curling brush being a retractable shaft rotatably mounted, a link is operatively connecting said spring-loaded retractable shaft to said connecting member whereby upon rotational displacement of said housing, said link member is translationally displaced and is turning said spring-loaded retractable shaft and thereby said curling brush is correspondingly rotated.

One of the preferred means for rotatably mounting a curling brush is on each side of said curling brush, a spring-loaded retractable shaft comprising:

a spool defining a ring having therein a radially extending annular partition, said annular partition defining an axial locking passage, said spool being in sandwich between a shaft slidable through said locking passage, said shaft having at one end a means for coupling one side of said curling brush and at the other end means for coupling a sleeve, and a central portion being slidable in said locking passage and to be locked in said passage whereby said shaft and said spool have the same angular velocity, said sleeve having one end and another end, said one end of said sleeve being coupled to said slidable shaft and at said another end and integral therewith, having an axial shank, said shank having mounted thereon a spring to urge said sleeve against said shaft and thereby to releasably hold said curling brush, at least one of said spring-loaded retractable shaft having means to urge said curling brush in an unturned position.

BRIEF DESCRIPTION OF THE DRAWINGS

In the drawings which illustrate some of the preferred ways of carrying out the invention.

DESCRIPTION OF SOME OF THE PREFERRED EMBODIMENTS

Figure 1:
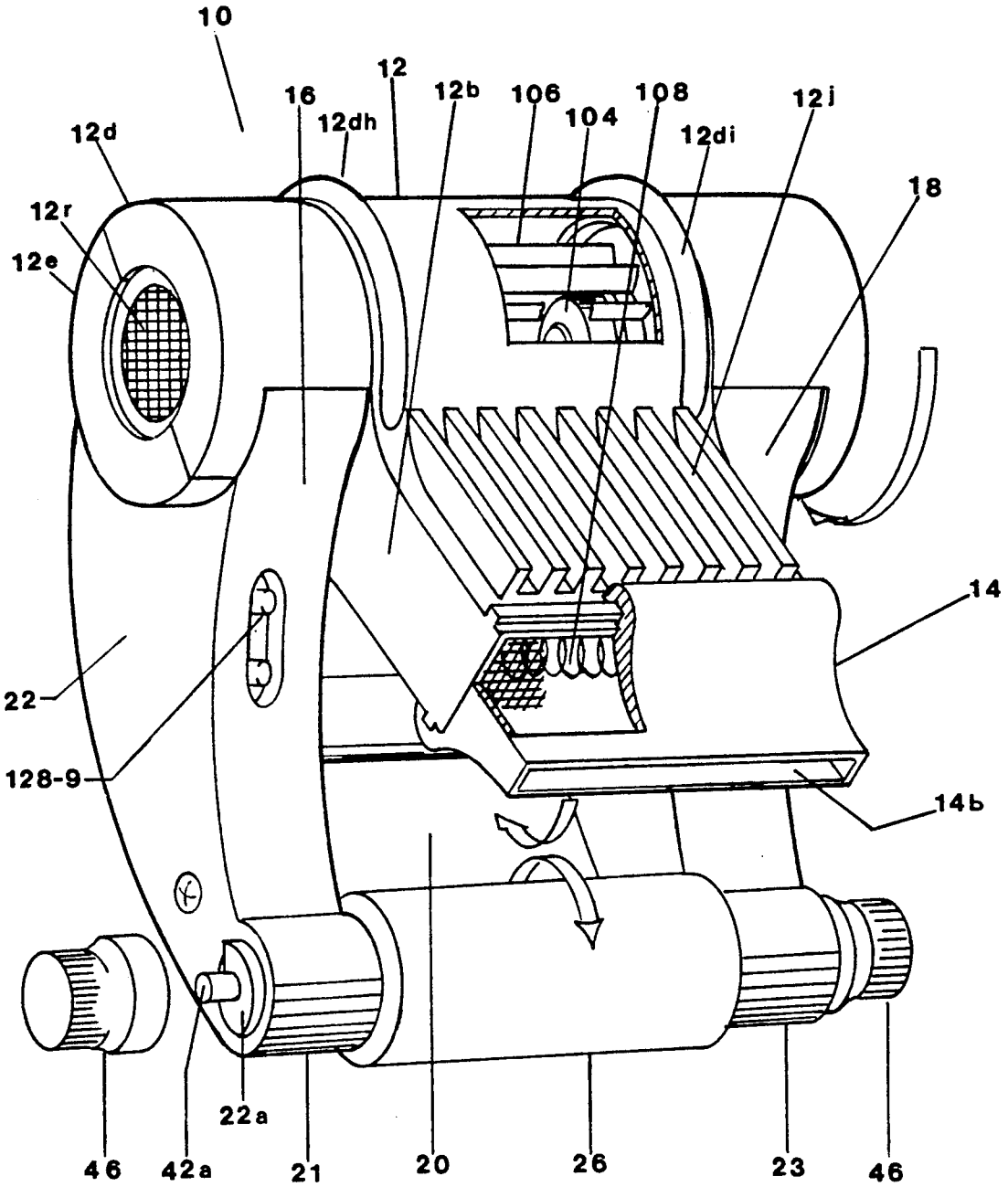
FIG. 1 is a perspective view a hand hair tamer.

As shown in FIG. 1, a hand hair tamer 10 having a central housing 12 including a hot air blowing dryer mounted therein, air inlet such as inlets or intakes 12*a* (FIG. 3) and a hot air nozzle outlet, preferably a quickly releasably mounted hot air nozzle 14 as will be discussed herein below. It is important that the air converges in a narrow nozzle outlet in order to increase the hot air velocity. Best results are obtained with the nozzle outlet terminating in a narrow rectangular slit or orifice outlet as shown at 14*b*, for hot air to rapidly set hair dry. Preferably, the hand hair tamer has a removably mounted air nozzle mounted in order to adapt various hot air nozzle outlets for various curling brushes of various diameters and to optimize and control the direction of the air flow on the curling brushes. The selection of one of said nozzle outlets of various lengths is selected in function of the diameters of the curling brushes in order to have a gap between the orifice outlet of said nozzle and said curling brush, said gap preferably not exceeding 0.5 inch.

Figure 4:
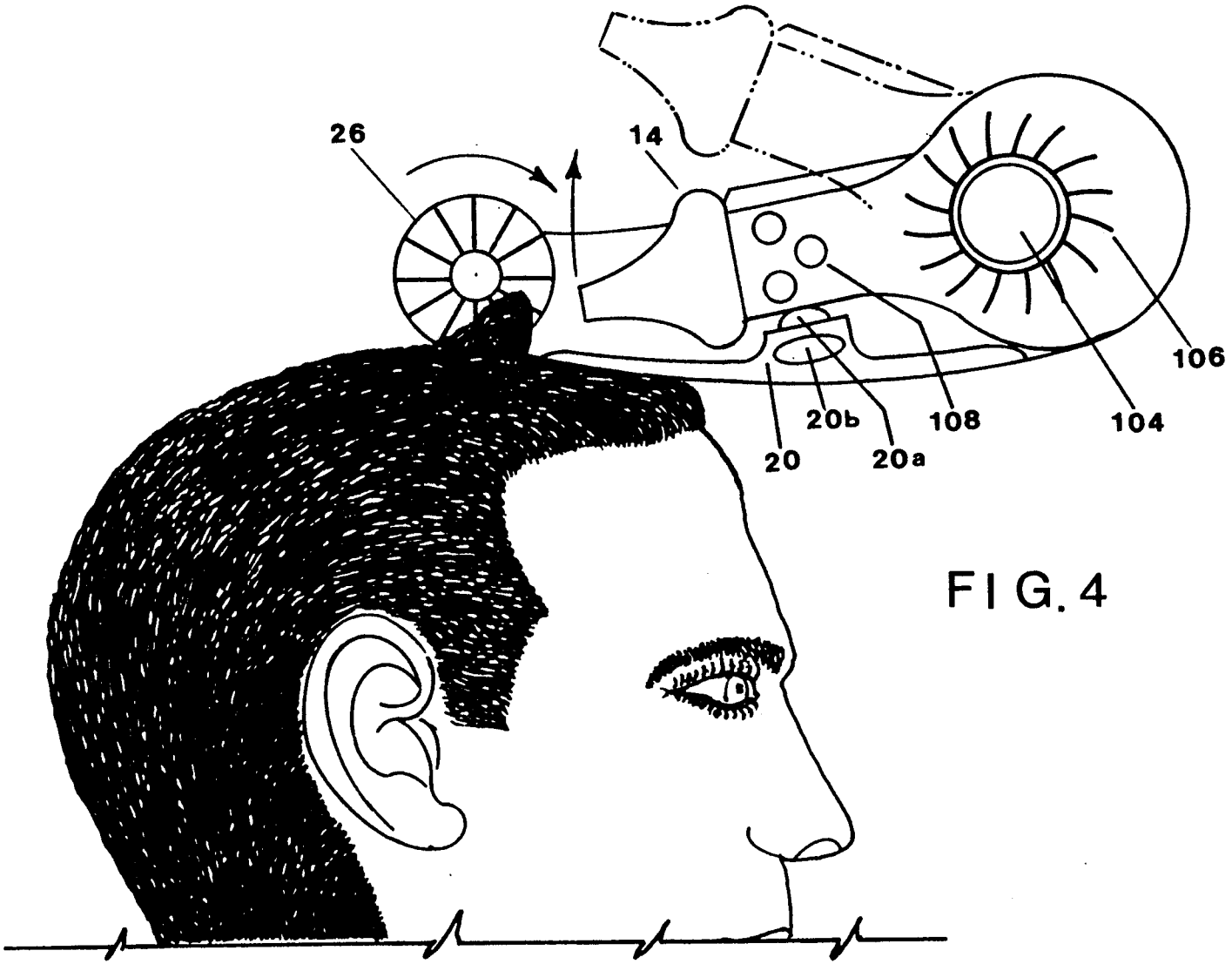
FIG. 4 is a schematic view illustrating the position of a hand hair tamer in operation and relative to a head.

A pair of hollow arms 16, 18, preferably C-shaped along the longitudinal axis, are rotatably mounted at one of their respective ends to said central housing 12 and to sandwich therebetween said housing, to laterally displace the curling brush's longitudinal axis with respect to the housing longitudinal axis, better shown in FIG. 4 whereby upon rotation of said means to blow air toward the center of said brush, said means to turn said brush rotates angularly said brush at a given angle, selected between about 80° to 110°, said rotation allowing said narrow nozzle outlet converging a narrow jet of hot air to stop short of the periphery of said brush adjacent a user's head, to direct said narrow converging jet of hot air parallel to or slightly toward said center to target said narrow converging jet of hot air on an area about mid-point between said center and the periphery of said brush adjacent a user's head.

Other means may be used for allowing rotation of said narrow converging jet of hot air, of the periphery of said brush adjacent a user's head, said rotation allowing said narrow converging jet of hot air to stop short of the periphery of said brush adjacent a user's head.

Cover plates 22,24 defining the outward walls of the hollow arms, are similarly shaped and have air openings or air intakes provided with air filtering screens such as screened shield 22*r*. In a particular embodiment, the screens are in recess in said arms, but may also be flushed or convex.

Figures 3, 3A:
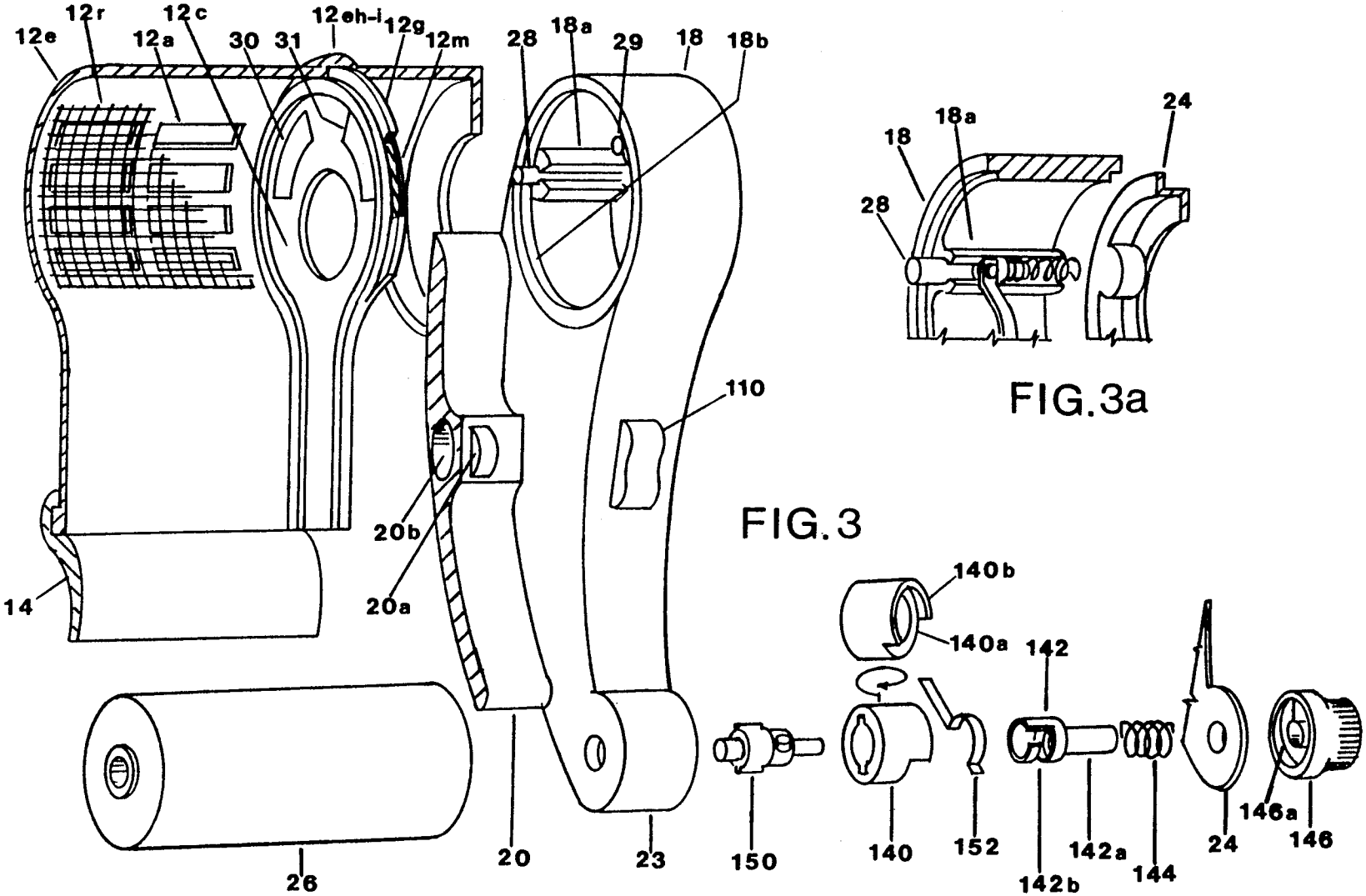
FIG. 3 is an explosive view illustrating the other side of the shaft mechanism of FIG. 2, and a perspective view of the partly cut out front and rear walls of the central housing with air intake electric crossover and of the adjacent arm.
FIG. 3A is an enlarged perspective portion of a fragment of the arm of FIG. 3, partly cut out.

A bridge 20, shown as a traverse member having a top, and a bottom outer surface, is used as means to join the arms 16, 18, to hold said arm against said housing and to synchronize rotational displacement of said arms 16, 18, and said top outer surface of said traverse member may also serve as a stopper of the rotational displacement of the central housing as shown at 20*a* FIG. 3. Said stopper may be adjustable if desired. The bridge 20 may also be provided with a passage such as 20*b*, to allow wiring for instance.

Each of the arms at their other end, is provided with means 21, 23 for rotatably mounting a curling brush 26, as will be discussed herein below.

In a preferred embodiment, (better shown in FIGS. 2 and 3), the central housing 12, comprises opposite side walls 12*b*, 12*c*, front wall 12*d*, and rear wall 12*e*: the front wall 12*d* and rear wall 12*e* fastened to the side walls and cooperating to define an enclosure including a passage where air converges, to terminate in the nozzle outlet 14. At one end the side walls 12*b*, 12*c* each respectively define an outwardly circular rim 12*f*, 12*g* and an annular collar 12*l*, 12*m*. Each of the walls 12*d*, 12*e* is provided with corresponding inward circular grooves 12*dh*, 12*di*, 12*eh* and 12*ei*, for confining therein said circular rims 12*f* and 12*g* respectively whereby said central housing and said front and rear walls are fastened together. The rear wall 12*e* further includes as shown in FIG. 3 a shield-screen portion 12*r* protecting the openings or air inlet 12*a*.

The inner wall of the arms 16, 18, adjacent said annular collar 12*l*, 12*m*, is recessed to define a circular seat 16*b*, 18*b*, thereby providing housing for and enabling rotation of the annular collar 121, 12*m*.

Preferably, the front wall 12*d* is provided with a plurality of energy dissipating ribs 12*j* which are of a sufficient depth to maintain appropriate temperature for hands and fingers to be comfortable.

One of the arms is provided, adjacent its annular collar 121 or 12*m*, with a passage for bridging within one of said arms a connecting member such as 12*k*, fixed to and preferably integral with the central housing 12. In a preferred embodiment, the connecting member is a circular drum integral with said side wall 12*b*, and thereby said housing. However, the connecting member such as 12*k*, may define a cam or other shape if desired according to the motion one wishes to obtain for the curling brush.

The arcuate or C-shape of the arms favours a delivery of a stream hot air parallel to a head to be styled. As shown for instance in FIG. 1 and 3, it should be noted that each of the hollow arms has one end and another end and a longitudinal axis between said ends; and that, each of said arms at their other end defines an extension perpendicular to said longitudinal axis of said arms and away from said longitudinal axis of said arms and said traverse member, and said extensions are provided with means for rotating, in between them, a curling brush.

Means for rotatably mounting a curling brush

Figures 2, 2A:
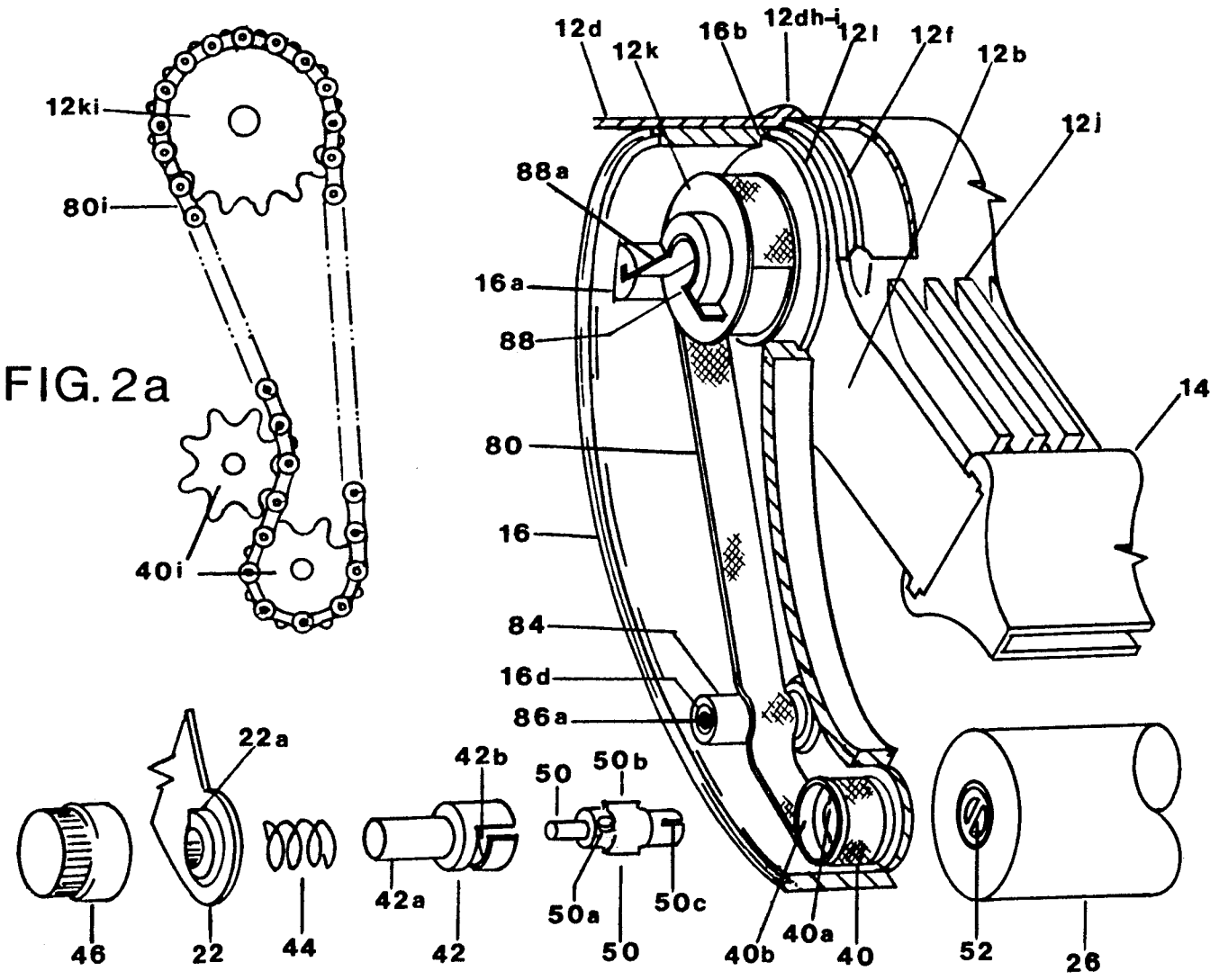
FIG. 2 is an explosive view of a side of a shaft release mechanism for rotatably mounting various types of curling brushes and of a perspective view of one of the means responsive to a rotational displacement of the central housing, to rotatably displace a curling brush.
FIG. 2A is a schematic view illustrating another means responsive to a rotational displacement of the central housing, to rotatably displace a curling brush.

As shown in FIG. 2, in a preferred embodiment the means 21, 23 for rotatably mounting a curling brush 26, enable insertion of interchangeable curling brushes. A spool 40 has a keyway 40*a* in a stopping rim 40*b*, and a sleeve 42 provided with a shank 42*a*, rotatably mountable within the spool 40. The sleeve 42 is provided with a L-shape slot 42*b*. The L-shape slot 42*b* is opened through the wall of the sleeve 42 parallel to its axis, then turning sharply 90° radially for some 120°. The shank 42*a* is provided with a spring 44 or other biassing means, and is rotatably mounted through the outward side cover plate 22 provided with an outwardly projecting spiralling boss 22*a*. The spring 44 squeezed between the cover plate 22 and the sleeve 42, is biassing inwardly the shank 42*a*. The end of the shank 42*a* is secured to a knob 46 which defines an inwardly projecting spiralling boss 46*a* similar to the outwardly projecting spiralling boss 22*a*, thereby said sleeve 42 via shank 42*a* is outwardly displaceable or retractable by the inwardly projecting spiralling boss of the knob 46 revolving upon the outwardly projecting spiralling boss 22*a*.

A three section bridging shaft 50, comprises a first section having a projection, for instance an outwardly projecting pin 50*a* to engage freely the radial part of the L-shape slot 42*b*. Incidentally this first section is preferably made longer to be received in part inside a void provided inside shank 42*a* adjacent sleeve 42. The pin is perpendicular to the shaft. A second or intermediate section of the shaft has an outward configuration matching that of the keyway 40*a* in the stopping rim 40*b* and is slidable therein. For instance ridges 50*b* symmetrically disposed, diametrically or otherwise. A third section is a male-female engagement, for instance a shaft having a diametric slot 50*c* to engage a female counterpart 52 defined in the curling brushes. The female counterpart is easily fitting the male or shaft, while being shrink fitted in the core of brush 26. Upon rotation of the knob 46 upon the spiralling boss, the shaft 50 is inwardly displaced through pin 50*a* trapped in slot 42*b*.

As shown in FIG. 3, the means 23 for rotatably mounting a curling brush 26 is as described above the same number plus 100 having been given for the corresponding element, except for the sleeve 142 which is provided with a L-shape slot 142*b* opening in the opposite direction. The spool 140 has a portion of the a side face in recess between the hub 140*a* and the rim 140*b*, the rim being partially cut opened, and a leaf spring 152 engages therein and extends and hooks around a cover screw lug 18*d* strategically positioned in order to urge the spools 140 and 40 to return to a rest or unturned position.

The lug 18*d* is similar to lug 16*d* in arm 16.

If a single curling brush is contemplated, the curling brush may simply be mounted about a rotatable shaft, including journal if desired.

Also other types of means for rotatably mounting a curling brush may be used, a pair of spring loaded axial cylinders slidable into one another may be used if desired. Another means is described in FIG. 5 herein below.

Means responsive to the rotational displacement of the central housing

In order to convey the rotatable displacement of the curling brush, a linking stretchfast fabric strap 80, (FIG. 2), is partly wrapped around and fastened to the connecting member 12*k* which is a circular drum, but may define a cam or other shape, arches around a roller bearing 84 mounted on the lug 16*d*, then wraps, fully drawn around the spool 40, and is affixed thereto. The lug 16*d* as well as 18*d* have at their respective free end, a groove or threaded portion 86*a* to secure side covers 22 and 24.

By stretchfast fabric is meant a fabric which will yield minimal elongation under tension.

The side covers 22 and 24 are fastened with a machine screw or a countersunk bolt or other means.

The connecting member 12*k* is also provided with a leaf spring 88 having a leg 88*a* fastened to the inner side of the arm 16. This may be conveniently obtained by anchoring the leg 88*a* to a swell 16*a* provided therefor on the inner side of the arm 16, or by other fastening means, to position the nozzle outlet 14, for instance as to obtain an acute angle, preferably of about 35°, with respect to the central housing-curling brush axis thereby said means for rotatably mounting the curling brush is operatively connected to a means responsive to the rotational displacement of the central housing 12 to rotatably displace the curling brush upon the rotational displacement of the housing using a force exceeding that of the springs 88 and 152 in a direction, as shown from the arrows in FIGS. 1 and 4, such that said periphery of said brush adjacent to a user's head, is displaced in a direction against the direction of said jet of hot air.

The ratio of the dimension of the connecting member 12*k* whether circular or oval drum, a cam or other shape, to that of the spool 40 is such that when the connecting member 12*k* is rotated about its axis downward 35°, the spool 40 rotates about 80° to 110° and preferably about 90°. By varying said ratio said spool may be caused to rotate the curling brush within an acceptable operable range of about 80° to 110°. Although the above describes a specific means responsive to the rotational displacement of the central housing, it should be known that other types may be used if desired, for instance as shown in FIG. 2A, the connecting member 12*ki*, and the spool 40*i* may be a sprocket wheels, and the linking strap 80*i*, a continuous chain wheel drivenly mounted to engage said sprocket wheels.

Other connecting members to the central housing for transmitting the rotary motion of said housing with respect to said arms, as well as other means for rotatably mounting a curling brush and for linking the two may be used.

As shown in FIG. 1, the central housing 12 includes a hot air generating blower mounted therein, comprising a motor 104 driven fan 106 having air inlet 12*a* and air outlet 14, and heat-insulated electrically heated air heating coils 108, preferably having variable heat intensity and motor speed. The motor is preferably mounted inside a hollow centrifugal fan.

In a preferred embodiment, as shown in FIG. 3 and 3A, a two-part current cross-over device is used , the wall 12*c* adjacent arm 18, is provided with bus bars 30 and 31 each respectively inwardly connected to one of the poles of the motor 104, heating coils 108 and auxiliaries, as is well known. In space relation to said bus-bars, spring loaded graphite pins 28, 29 are used for contacting said bus-bars. Each pin is connected to an insulated braided wire lead eventually leading to control switch 110, and to a prong 128, 129 (FIG. 1), which can also be a three-prong system.

The central housing 12, the arms 14, 16, the drum, the nozzle outlet, the retractable shaft and the components that can, are preferably moulded such as with plastic materials polymeric or man made.

Operation

A way to treat short hair, such as cowlicks for instance, and particularly rebel short hair, is first to towel-dry shampooed hair as to remain damp, and thereby to yield when combed in the desired direction and to temporary maintain a given shape. Massaging into the rebel hair a small amount of styling foam is preferred to achieve this shape. Rebel hair must be moulded or curled in the desired position in order to obtain durable setting.

With a cylindrical hair brush resting on the hair to be treated, the brush is rotated preferably about 90° about its axis. This causes the hair to be lifted at its root and curved back on itself to form a sort of loop configuration in the desired direction. It should noted that the hair is never wound upon the brush but rather entrapped in the bristles of the brush in the area between the scalp an the core of the brush as illustrated in FIG. 4.

Curled hair must be dried quickly to freeze to the loop configuration. For this purpose, a high velocity thin flow of moderately heated air is directed at said loop configuration, parallel to the head while sparing the scalp. For this purpose a self producing means within said hand hair tamer to blow at high velocity a narrow converging jet of hot air is necessary. The nozzle opening is in a particular embodiment, rectangular with a height not exceeding 0.25 inch. The tip of the nozzle should be held close, preferably within 0.5 inch to entrap hair. As the air is heated, its volume increases and when forced through the nozzle its velocity increases many folds. This air volume and velocity coupled with the proximity of the nozzle opening yield maximum results as shown in FIG. 4. Thus preferably said narrow nozzle outlet has a rectangular orifice outlet with a height not exceeding 0.25 inch, and wherein upon rotational displacement of said nozzle outlet, said orifice stops no more than half an inch from the short hair in a curved fashion on the periphery of said brush and a user's head, on an area about mid-point between said center and the periphery of said brush adjacent said user's head.

Once the hot air generating blower of the hand hair tamer is actuated, air is blown at an oblique angle of about 35° with respect to the axis of the curling brush 26, as measured from the axis of rotation of the housing 12, because of the leaf spring 88 keeping the air outlet 14 in this oblique position. The hand hair tamer is held in a substantially horizontal position, for instance with a tomb under each arm and the fingers against the energy dissipating ribs 12*j*. As shown in FIG. 4, the curling brush 26 resting on towel dry hair, styling cream treated or not, the curling brush 26 is triggered with manual pressure by lowering the narrow nozzle air outlet 14 against the resistance of the leaf springs 152 and 88. The linking strap 80, (FIG. 2), winds around the connecting member 12*k* while unwinding from the spool 40 to rotate the curling brush 26. By the time the air outlet 14 reaches the end of its course, the curling brush 26 will have turned from 0° to 110°, preferably some 90° around its axis and the hair entrapped in curler bristles will have curved back on itself with the loop, thus formed immediately in front of the air outlet 14, to dry in this configuration in a matter of seconds. Release of the manual pressure against the resistance of the leaf springs 88 and 152, will cause return of both the nozzle 14 and the curling brush 26, to their original position, ready to repeat a new cycle upon reposition of the hand hair tamer. All this is attained without assistance of an operator but is self operated.

Figure 5:
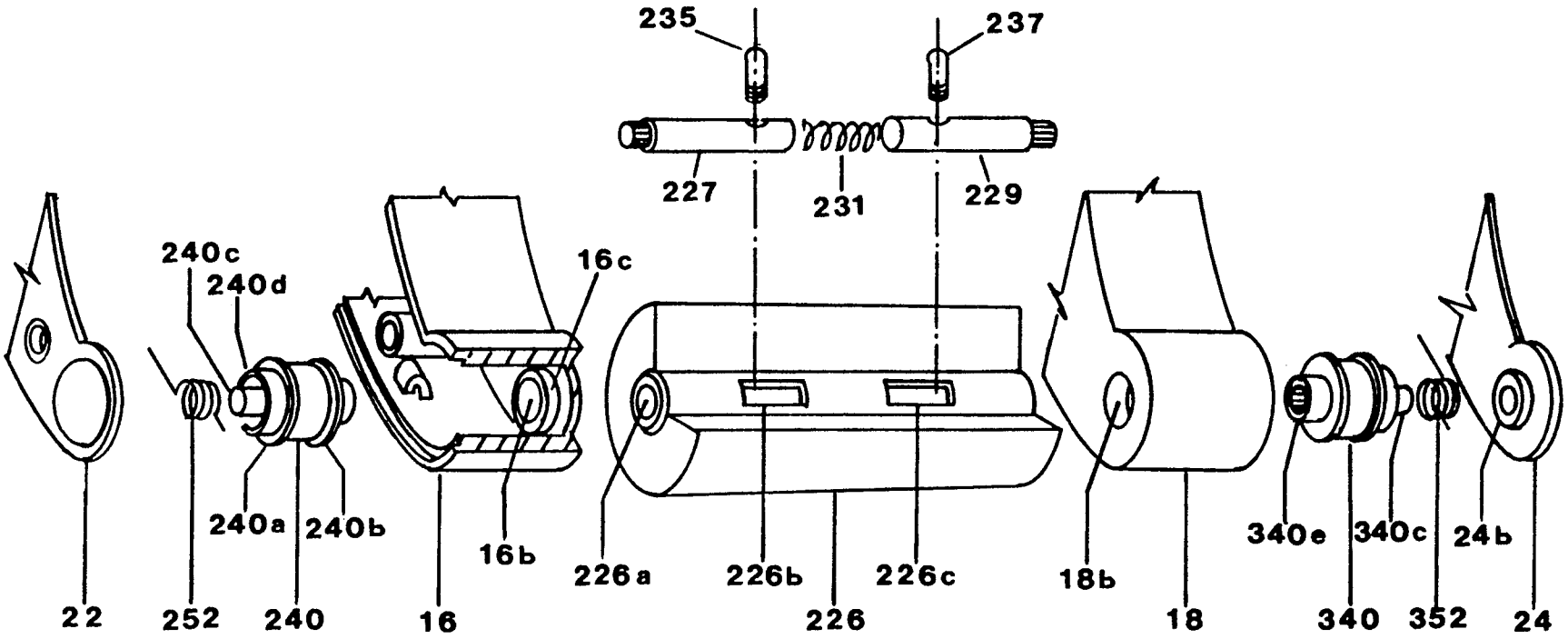
FIG. 5 is an explosive view of another release mechanism for rotatably mounting various types of curling brushes.

As shown in FIG. 5, in another preferred embodiment, the means for rotatably mounting a curling brush 226 comprises on each side an interchangeable spool 240, 340 having guiding flanges or ribs 240*a*, 240*b* and 340*a*, 340*b* for confining therebetween a linking stretchfast fabric strap 80 or the like fastened thereto. On the side opposite a curling brush 226, the spool 240 has an axle 240*c* and a partly open skirt 240*d* coaxial therewith for receiving therebetween a torsion spring 252 to engage therein and to rest against an inner wall of the hollow arm 16, and similarly is the spool arrangement of spool 340 to rest against an inner wall of the hollow arm 18. The cover plates 22, 24 are provided with a skirt such as 24*b* to receive the end of the axle 340*c* and thereby enabling rotation of said axle. On the side adjacent the curling brush, the spools 240 and 340 have each respectively and integral therewith, a ring such as 340*e* having an outer surface to engage a circular orifice 16*b* provided therefor in arm 16 and a ring such as 16*c*, coaxial with said orifices and integral with said arm 16 to enable rotation of said ring 340*e* and thereby said spool 340. Similarly is the spool arrangement of spool 240. The rings 340*e* as well as that of spool 240 have each independently an inner wall defining a female socket. The curling brush 226 has a core 226*a* provided with bristles except for a segment of about 150° which is bristle-free to accommodate spring loaded stub axles 227, 229 slidably mounted within a bore within said core 226*a* and being urged outwardly by a spring 231 and 233. These axles 227, 229 have their respective free ends shaped as the male elements to be received by the female sockets of ring 240 and 340. These axles have also threadly mounted thereon pins 235, 237 emerging through the core 226*a* via their respective slots 226*b* and 226*c* which are such as to allow disengagement of said axles from said spools by pulling the pins 235, 237 together and engagement upon release of said pins. The spool 240 or 340 is provided with a linking stretchfast fabric such as a flexible strap 80, as shown in FIG. 2. Thus is provided a curling brush having a center and a periphery, further defines opposite ends and a longitudinal axis therebetween, and wherein along said longitudinal axis at each of said opposite ends, a retractable spring loaded stub-axle is slidably mounted and outwardly urged from said curling brush, said brush having near each of said opposite ends, a slot radially extending from one of the the stub-axles to the periphery of the brush, each of said stub-axles having connected thereto an arm outwardly projecting from one of said slots for retracting said stub-axles.

Figure 6:
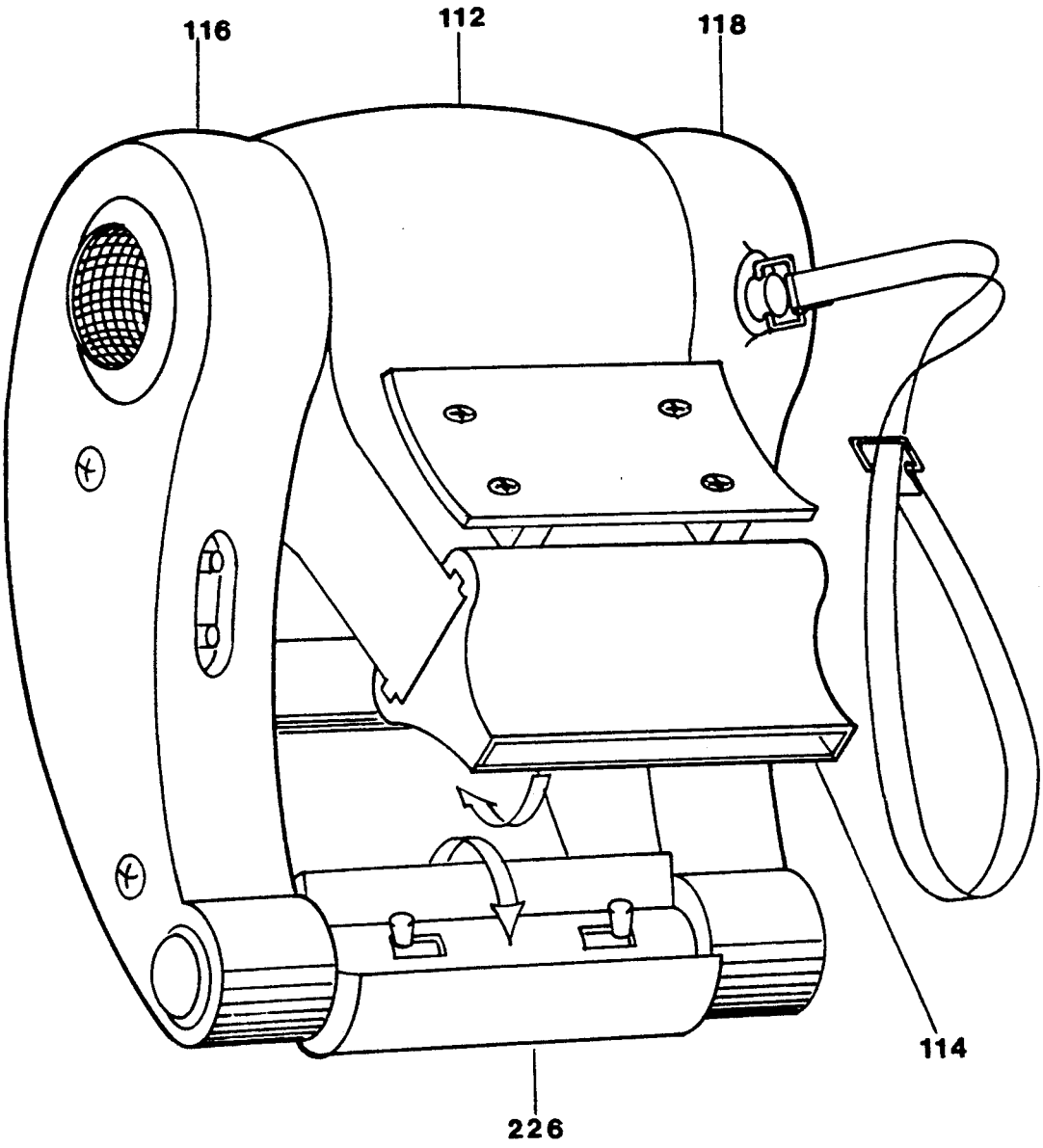
FIG. 6 is a perspective view another hand hair tamer with the release mechanism of FIG. 5.

FIG. 6 illustrates is a more compact version of the self-operable portable hand hair tamer for rebel short hair, using the simplified release mechanism for rotatably mounting various types of curling brushes described in FIG. 5: the central housing containing the central hot air blowing dryer 112, including a removably mountable nozzle 114 within arms 116, 118.

Although a few preferred ways of carrying out the invention have been disclosed, it should be noted that numerous modifications and variations thereof are within the true spirit and scope of the present invention, for instance the means to partly turn said brush at a given position and to releasably hold said brush in said given position, to lay in a curved fashion on the periphery of said brush in contact with a client head, the hair between said brush and said head, entrapped by said brush, as to loop hair on said brush, may be a cam, or the drum may be oval-shaped or have other shapes as desired.

While some of the preferred embodiments have been described herein above, it is to be understood that the invention is not to be construed as limited to these preferred embodiments, as many modification are possible within the spirit and scope of the appended claims.

I claim:

1. A self-operable portable hand hair tamer for styling short hair, particularly rebel short hair, comprising:

a central hot air blowing dryer having a narrow nozzle outlet to blow at high velocity a narrow converging jet of hot air, a pair of hollow arms, each of said arms having one end and another end and a longitudinal axis between said ends, said blowing dryer being rotatably mounted and sandwiched between said one end of each of said arms, for rotational displacement of said narrow nozzle with respect to said arms, a traverse member to bridge said arms, between their respective said one end and another end, said traverse member having a top, and a bottom outer surface, each of said arms at their other end defining an extension perpendicular to said longitudinal axis of said arms and away from said longitudinal axis of said arms and said traverse member, and said extensions being provided with means for rotating, in between them, a curling brush to grasp and loop short hair, said brush having a center and a periphery, said means for rotating said curling brush being operatively connected to a means responsive to said rotational displacement of said nozzle with respect to said arms, whereby upon rotational displacement of said nozzle from an original position away from said curling brush to a position wherein said narrow nozzle outlet delivers said narrow converging jet of hot air between the center of said brush and the periphery of said brush adjacent to a user's head, said curling brush rotates at a given angle selected between 80° to 110° from an original position and in a direction such that said periphery of said brush adjacent to a user's head, is displaced in a direction against the direction of said jet of hot air, said top outer surface of said traverse member cooperating with said hot air blowing dryer to stop rotation of said narrow nozzle outlet so as to deliver said narrow converging jet of air between the center of said brush and within the periphery of said brush to be adjacent to the user's head, whereby upon laying the bottom outer surface of said traverse member against a user's head and rotationally displacing said nozzle from said original position away from said curling brush to said position toward said curling brush, said brush rotates at said given angle, on the user's head and thereby without wrapping said hair around said brush, to releasably hold said brush at said given angle to entrap the free ends of said short hair and to lay in a curved fashion and short hair on the periphery of said brush, located between the center of said brush and said user's head, the hair between said brush and said head being entrapped and curled by said brush and immediately receiving said narrow converging jet of air between the center of said brush and within the periphery of said brush adjacent to said user's head, until said nozzle returns to its original position.

2. The hand hair tamer as defined in claim 1, which includes means constantly forcing said brush to return to said original position and means for constantly biassing said nozzle away from said brush in said rest position.

3. The hand hair tamer as defined in claim 1, wherein said narrow nozzle outlet has a rectangular orifice outlet with a height not exceeding 0.25 inch and wherein upon rotational displacement of said nozzle outlet, said orifice stops no more than half an inch from the entrapped short hair in a curved fashion, on an area about mid-point between said center and the periphery of said brush said user's head and directing said air substantially parallel to said head at said periphery.

4. The hand hair tamer as defined in claim 1, wherein said means responsive to said rotational displacement of said nozzle with respect to said arms, for rotating said curling brush is mounted within said hollow arm.

5. The hand hair tamer as defined in claim 1, wherein said means for rotating a curling brush is a spring-loaded retractable shaft rotatably mounted.

6. The hand hair tamer as defined in claim 5, wherein said curling brush having a center and a periphery, further defines opposite ends and a longitudinal axis therebetween, and wherein along said longitudinal axis at each of said opposite ends, a retractable spring loaded stub-axle is slidably mounted and outwardly urged from said curling brush, said brush having near each of said opposite ends, a slot radially extending from one of the the stub-axles to the periphery of the brush, each of said stub-axles having connected thereto an arm outwardly projecting from one of said slots for retracting said stub-axles.

7. The hand hair tamer as defined in claim 1, wherein said arms are C-shaped.

8. The hand hair tamer as defined in claim 1, wherein said hot air blowing dryer consists of electrically heating elements and a motor driven fan blowing air against said elements, electric wiring therefor including between said housing and one of said arms, pins in contact with bus bars.

9. The hand hair tamer as defined in claim 1, wherein said means for rotating a curling brush is on each side of said curling brush, a spring-loaded retractable shaft comprising:

a spool defining a ring having therein a radially extending annular partition defining an axial locking passage, said spool being in sandwich between a shaft slidable through said locking passage, said shaft having at one end, a means for coupling one side of said curling brush and at the other end means for coupling a sleeve, and a central portion slidable in said locking passage and to be locked in said passage whereby said shaft and said spool have the same angular velocity, said sleeve having one end and another end, said one end of said sleeve being coupled to said slidable shaft and at said another end and integral therewith, having an axial shank, said shank having mounted thereon a spring to urge said sleeve against said shaft and thereby to releasably hold said curling brush, at least one of said spring-loaded retractable shaft having means to urge said curling brush in an unturned position.

10. The hand hair tamer as defined in claim 9, wherein at least one of said spools defining a ring having therein a radially extending annular partition, has a cut out portion to receive a spring acting as said means to urge said curling brush in an unturned position.

11. The hand hair tamer as defined in claim 1, wherein said central hot air blowing dryer having a narrow nozzle outlet is mounted in a central housing, and said pair of arms are rotatably mounted to said housing.

12. The hand hair tamer as defined in claim 1, wherein said central hot air blowing dryer having a narrow nozzle outlet is mounted in a central housing, said pair of arms are rotatably mounted to said housing, one of said arms is provided, at said one end, with a passage for bridging within said arms a connecting member to the central housing for transmitting the rotary motion of said housing with respect to said arms, said connecting member being provided with a means to urge said housing with respect to said member at an acute angle, said means for rotating a curling brush being a retractable shaft rotatably mounted, a link is operatively connecting said spring-loaded retractable shaft to said connecting member whereby upon rotational displacement of said housing, said link member is translationally displaced and is turning said spring-loaded retractable shaft and thereby said curling brush is correspondingly rotated.

13. The hand hair tamer as defined in claim 12, wherein said connecting member is selected from the group consisting of cams, oval-shaped and circular drums.

14. The hand hair tamer as defined in claim 12, wherein said connecting member includes a sprocket wheel, said spring-loaded retractable shaft includes a sprocket wheel and said link is a chain engaging the sprockets of said sprocket wheels.

15. The hand hair tamer as defined in claim 12 wherein said one of said arms is provided, at said one end, with a passage for bridging within one of said arms a connecting member to the central housing, said connecting member defines a circular drum integral with said housing, said circular drum being provided with a means to urge said arm with respect to said housing at an acute angle, said spring-loaded retractable shaft being drivenly connected to a spool, a strap operatively connecting said spool to said drum whereby upon rotational displacement of said nozzle, said strap is translationally displaced and is turning said spool and thereby said curling brush is correspondingly rotated.

16. The hand hair tamer as defined in claim 15, wherein said acute angle is about 35°.

17. The hand hair tamer as defined in claim 12, wherein said central housing is provided with a plurality of energy dissipating ribs.

18. The hand hair tamer as defined in claim 1 which includes an adjustable means cooperating between said top outer surface of said traverse member and said hot air blowing nozzle, for allowing said narrow nozzle outlet to stop short of the periphery of said brush adjacent a user's head, to target said narrow converging jet of hot air on said entrapped hair on an area about midpoint between said center and the periphery of said brush adjacent a user's head and directing said air substantially parallel to said head at said periphery.

19. The hand hair tamer as defined in claim 1, wherein said hot air nozzle outlet is removably mountable in order to adapt various hot air nozzle outlets of various lengths, various bristle structures and to optimize the direction of the hot air flow on curling brushes of various diameter.

20. The hand hair tamer as defined in claim 19, wherein the selection of one of said nozzle outlets of various lengths is selected as function of the diameters of the curling brushes in order to have a gap between the orifice outlet of said nozzle and said curling brush, said gap not exceeding 0.5 inch.

* * * * *